US009384692B2

(12) United States Patent
Choi

(10) Patent No.: US 9,384,692 B2
(45) Date of Patent: Jul. 5, 2016

(54) ORGANIC LIGHT EMITTING DISPLAY HAVING A REDUCED NUMBER OF SIGNAL LINES

(75) Inventor: Sang-Moo Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 997 days.

(21) Appl. No.: 13/097,023

(22) Filed: Apr. 28, 2011

(65) Prior Publication Data

US 2012/0105420 A1 May 3, 2012

(30) Foreign Application Priority Data

Oct. 28, 2010 (KR) ..... 10-2010-0105797

(51) Int. Cl.
*G09G 3/32* (2006.01)

(52) U.S. Cl.
CPC ..... *G09G 3/3233* (2013.01); *G09G 2300/0804* (2013.01); *G09G 2300/0814* (2013.01); *G09G 2300/0819* (2013.01); *G09G 2300/0842* (2013.01); *G09G 2300/0861* (2013.01); *G09G 2320/0214* (2013.01); *G09G 2320/0252* (2013.01)

(58) Field of Classification Search
None
See application file for complete search history.

(56) References Cited

U.S. PATENT DOCUMENTS

2001/0002703 A1* 6/2001 Koyama ..... 257/40
2006/0071221 A1 4/2006 Park et al.
2007/0024541 A1* 2/2007 Ryu et al. ..... 345/76
2008/0036704 A1* 2/2008 Kim et al. ..... 345/76
2008/0218497 A1* 9/2008 Takahashi ..... 345/204
2009/0243976 A1* 10/2009 Choi ..... 345/76
2010/0053226 A1* 3/2010 Handa ..... G09G 3/3233 345/690

FOREIGN PATENT DOCUMENTS

| | | | |
|---|---|---|---|
| CN | 1790728 | A | 6/2006 |
| CN | 101123071 | A | 2/2008 |
| CN | 101561597 | A | 10/2009 |
| CN | 101697269 | A | 4/2010 |
| KR | 10-20050005646 | A | 1/2005 |
| KR | 10-20060056791 | A | 5/2006 |
| KR | 10-20070083072 | A | 8/2007 |

OTHER PUBLICATIONS

SIPO Office action dated Dec. 24, 2014, for corresponding Chinese Patent application 201110187714.4, (7 pages).

* cited by examiner

*Primary Examiner* — Kathy Wang-Hurst
*Assistant Examiner* — Matthew Yeung
(74) *Attorney, Agent, or Firm* — Lewis Roca Rothgerber Christie LLP

(57) ABSTRACT

An organic light emitting display includes common coupling units at crossing regions of scan lines and data lines; first pixels at the crossing regions and positioned on an ith horizontal line to be coupled to the common coupling units positioned at the same crossing regions, wherein i is a positive integer; second pixels at the crossing regions and positioned on an (i+1)th horizontal line to be coupled to the common coupling units positioned at the same crossing regions; first control lines coupled to the first pixels; and second control lines coupled to the second pixels.

9 Claims, 6 Drawing Sheets

ORGANIC LIGHT EMITTING DISPLAY HAVING A REDUCED NUMBER OF SIGNAL LINES

CROSS-REFERENCE TO RELATED APPLICATION

This application claims priority to and the benefit of Korean Patent Application No. 10-2010-0105797, filed on Oct. 28, 2010, in the Korean Intellectual Property Office, the entire content of which is incorporated herein by reference.

BACKGROUND

1. Field

The present invention relates to an organic light emitting display.

2. Description of Related Art

Cathode ray tubes (CRTs) have been used to display images. However, CRTs have the disadvantages of being heavy and large in size. Recently, various flat panel displays (FPDs) have been developed that are capable of reducing the heavier weight and larger volume that are the disadvantages of CRTs. Examples of FPDs include liquid crystal displays (LCDs), field emission displays (FEDs), plasma display panels (PDPs), and organic light emitting displays.

Organic light emitting displays can display images using organic light emitting diodes (OLEDs) that generate light by re-combination of electrons and holes. An organic light emitting display has a high response speed and can be driven with low power consumption.

An organic light emitting display includes pixels positioned at crossing regions of data lines and scan lines, a data driver for supplying data signals to data lines, and a scan driver for supplying scan signals to scan lines.

The scan driver sequentially supplies scan signals to scan lines. The data driver supplies data signals to data lines in synchronization with the scan signals.

The pixels are selected when the scan signals are supplied to the scan lines to receive the data signals from the data lines. At this time, the storage capacitors included in the pixels are charged with voltages corresponding to the data signals, and driving transistors control the amount of current supplied from a first power source to a second power source via organic light emitting diodes (OLED), to correspond to the voltages charged in the storage capacitors.

A method of additionally storing the threshold voltages of the driving transistors in the storage capacitors in order to reduce (or minimize) the effect of variations in the threshold voltages of the driving transistors included in the pixels has been used. A structure in which the driving transistors are coupled to each other in the form of a diode may be added to the pixels. Also, in order to turn on the driving transistors coupled to each other in the form of a diode, a structure may be added to the pixels in which initializing voltages that are lower than data signals are supplied to the gate electrodes of the driving transistors.

In such a case, a plurality of transistors are included in the pixels and a plurality of signal lines are formed in a horizontal direction in order to control the transistors. However, as a display panel is enlarged, the switching speed of the transistors is reduced due to (or by) the signal delay phenomenon of the signal lines formed in the horizontal direction.

SUMMARY

Accordingly, embodiments of the present invention provide an organic light emitting display capable of increasing the switching speed of the transistors included in pixels.

Embodiments of the present invention also provide an organic light emitting display capable of reducing (or minimizing) the number of signal lines formed in a horizontal direction.

Embodiments of the present invention provide an organic light emitting display including common coupling units at crossing regions of scan lines and data lines; first pixels at the crossing regions and positioned on an ith horizontal line to be coupled to the common coupling units positioned at the same crossing regions, wherein i is a positive integer; second pixels at the crossing regions and positioned on an (i+1)th horizontal line to be coupled to the common coupling units positioned at the same crossing regions; first control lines coupled to the first pixels; and second control lines coupled to the second pixels. One of the scan lines may be located every two horizontal lines.

The organic light emitting display may further include a scan driver for sequentially supplying scan signals to the scan lines; a data driver for supplying data signals to the data lines; and a control line driver for supplying a first control signal to the first control lines and for supplying a second control signal to the second control lines. The scan driver may be configured to supply each of the scan signals to have a duration of two horizontal periods. The control line driver may be configured to sequentially supply the first control signal and the second control signal in a period during which one of the scan signals is supplied.

The data driver may be configured to supply a first data signal of the data signals, to be supplied to a corresponding one of the first pixels, to a corresponding one of the data lines while the first control signal is being supplied, and to supply a second data signal of the data signals, to be supplied to a corresponding one of the second pixels, to a corresponding one of the data lines while the second control signal is being supplied. The common coupling units may be between the data lines and the first pixels and the second pixels, and may include first transistors configured to turn on when the scan signals are supplied to the scan lines.

Each of the first pixels may include an organic light emitting diode (OLED); a second transistor for controlling an amount of current supplied from a first power source to the OLED; a storage capacitor coupled between the first power source and a gate electrode of the second transistor; and a third transistor coupled between the gate electrode of the second transistor and a corresponding one of the common coupling units and configured to turn on when the first control signal is supplied.

Each of the second pixels may include an OLED; a second transistor for controlling an amount of current supplied from a first power source to the OLED; a storage capacitor coupled between the first power source and a gate electrode of the second transistor; and a third transistor coupled between the gate electrode of the second transistor and a corresponding one of the common coupling units and configured to turn on when the second control signal is supplied.

According to another embodiment, an organic light emitting display includes first pixels on an ith horizontal line, wherein i is a positive integer; second pixels on an (i+1)th horizontal line; scan lines and emission control lines coupled to the first pixels on the ith horizontal line and the second pixels positioned on the (i+1)th horizontal line; data lines crossing the scan lines and the emission control lines and coupled to the first pixels and the second pixels; first control lines coupled to the first pixels; and second control lines coupled to the second pixels.

The organic light emitting display may further include a scan driver for sequentially supplying scan signals to the scan lines and for sequentially supplying emission control signals to the emission control lines; a data driver for supplying data signals to the data lines; and a control line driver for supplying a first control signal to the first control lines and for supplying a second control signal to the second control lines.

The scan driver may be configured to supply each of the scan signals to have a duration of two horizontal periods. The scan driver may be configured to supply one of the emission control signals to a jth emission control line from among the emission control lines to overlap the scan signals supplied to a (j−1)th scan line and a jth scan line from among the scan lines, wherein j is a positive integer. The control line driver may be configured to sequentially supply the first control signal and the second control signal while the scan signals are being supplied.

The data driver may be configured to supply a first data signal of the data signals, to be supplied to a corresponding one of the first pixels, to a corresponding one of the data lines while the first control signal is being supplied, and to supply a second data signal of the data signals, to be supplied to a corresponding one of the second pixels, to a corresponding one of the data lines while the second control signal is being supplied.

Each of the first pixels and the second pixels may include an OLED; a second transistor for controlling an amount of current supplied from a first power source coupled to a first electrode of the second transistor to the OLED; a first transistor coupled between the first electrode of the second transistor and a corresponding one of the data lines and configured to turn on when one of the scan signals is supplied to a jth scan line from among the scan lines, wherein j is a positive integer; a storage capacitor coupled between a gate electrode of the second transistor and the first power source; a fourth transistor serially coupled between the gate electrode of the second transistor and an initial power source and configured to turn on when one of the scan signals is supplied to a (j−1)th scan line from among the scan lines; a fifth transistor coupled between the second transistor and the first power source and configured to turn off when one of the emission control signals is supplied to a jth emission control line from among the emission control lines; and a sixth transistor coupled between the second transistor and the OLED and configured to turn off when the one of the emission control signals is supplied to the jth emission control line.

Each of the first pixels may further include a first third transistor coupled between the gate electrode of the second transistor and a second electrode of the second transistor and configured to turn on when the one of the scan signals is supplied to the jth scan line; and a second third transistor coupled between the first third transistor and the second electrode of the second transistor and configured to turn on when the first control signal is supplied to a corresponding one of the first control lines.

Each of the second pixels may further include a first third transistor coupled between the gate electrode of the second transistor and a second electrode of the second transistor and configured to turn on when the one of the scan signals is supplied to the jth scan line; and a second third transistor coupled between the first third transistor and the second electrode of the second transistor and configured to turn on when the second control signal is supplied to a corresponding one of the second control lines.

The organic light emitting display may further include a first transistor having a second electrode coupled to a corresponding one of the first pixels and a corresponding one of the second pixels, a first electrode coupled to a corresponding one of the data lines, the first transistor being configured to turn on when one of the scan signals is supplied to a jth scan line from among the scan lines, wherein j is a positive integer.

Each of the first pixels and the second pixels may include an OLED; a second transistor for controlling an amount of current supplied from a first power source coupled to a first electrode of the second transistor to the OLED; a storage capacitor coupled between a gate electrode of the second transistor and the first power source; a plurality of fourth transistors serially coupled between the gate electrode of the second transistor and an initial power source and configured to turn on when one of the scan signals is supplied to a (j−1)th scan line from among the scan lines; a fifth transistor coupled between the second transistor and the first power source and configured to turn off when one of the emission control signals is supplied to a jth emission control line from among the emission control lines; and a sixth transistor coupled between the second transistor and the OLED and configured to turn off when the one of the emission control signals is supplied to the jth emission control line.

Each of the first pixels may further include a first third transistor coupled between the gate electrode of the second transistor and a second electrode of the second transistor and configured to turn on when the one of the scan signals is supplied to the jth scan line; and a second third transistor coupled between the first third transistor and the second electrode of the second transistor and configured to turn on when the first control signal is supplied to a corresponding one of the first control lines.

Each of the second pixels may further include a first third transistor coupled between the gate electrode of the second transistor and a second electrode of the second transistor and configured to turn on when the one of the scan signals is supplied to the jth scan line; and a second third transistor coupled between the first third transistor and the second electrode of the second transistor and configured to turn on when the second control signal is supplied to a corresponding one of the second control lines.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
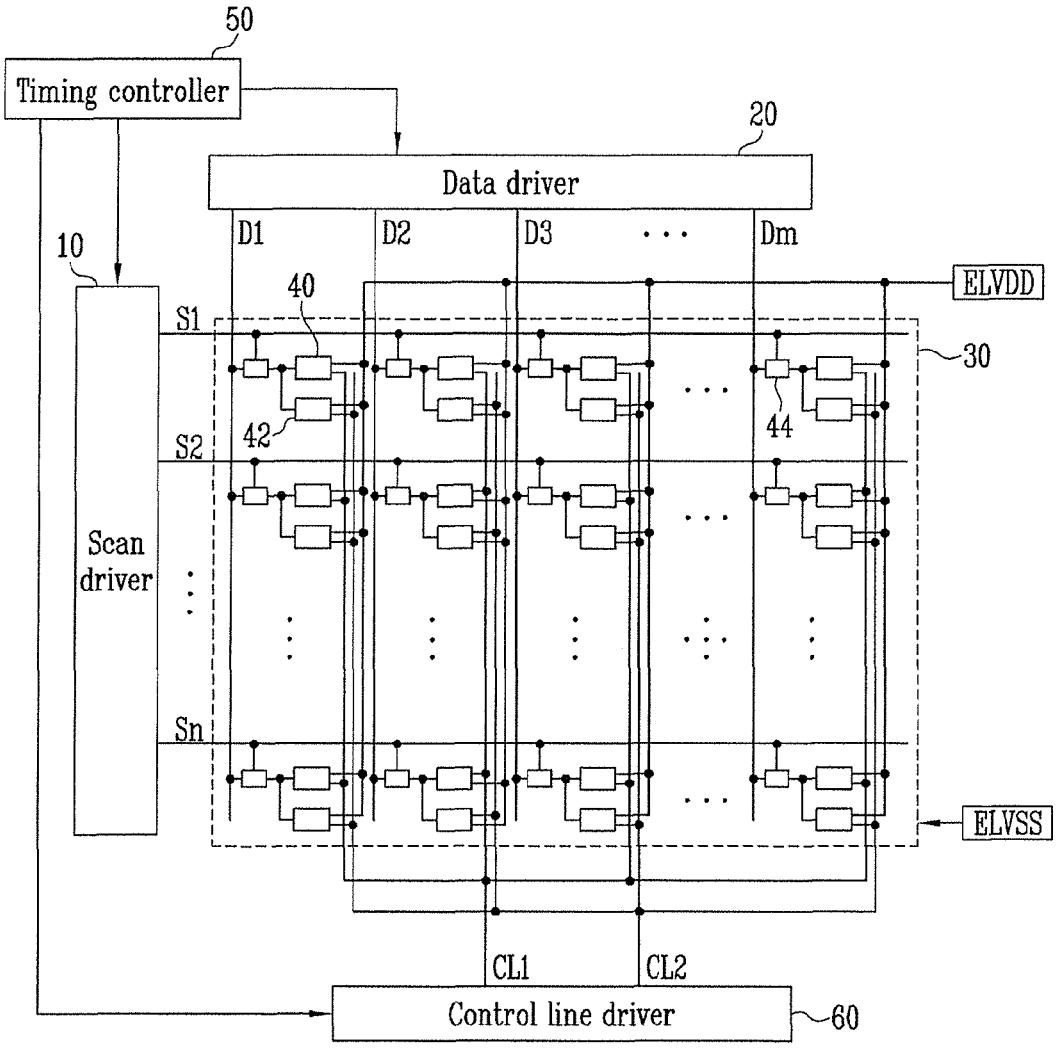
FIG. 1 is a view illustrating an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity. Also, like reference numerals refer to like elements throughout.

Embodiments by which those skilled in the art may perform the present invention will be described with reference to FIGS. 1 to 7.

FIG. 1 is a view illustrating an organic light emitting display according to an embodiment of the present invention.

Referring to FIG. 1, an organic light emitting display according to an embodiment of the present invention includes a display unit 30 including first and second pixels 40 and 42 formed on respective horizontal lines, a first control line CL1 coupled to the first pixels 40 positioned on an ith (i is an odd or even number) horizontal line, a second control line CL2 coupled to the second pixels 42 positioned on an (i+1)th horizontal line, common coupling units 44 positioned at the crossing regions of scan lines S1 to Sn and data lines D1 to Dm and coupled to the first pixels 40 and the second pixels 42 positioned to be adjacent to each other, a scan driver 10 for driving the scan lines S1 to Sn, a data driver 20 for driving data lines D1 to Dm, a control line driver 60 for driving the first control line CL1 and the second control line CL2, and a timing controller 50 for controlling the scan driver 10, the data driver 20, and the control line driver 60.

The common coupling units 44 are formed at the crossing regions of the scan lines S1 to Sn and the data lines D1 to Dm. The common coupling units 44 are formed at the same crossing regions where the first pixels 40 positioned on the ith horizontal line and the second pixels 42 positioned on the (i+1)th horizontal line are commonly coupled to each other. The common coupling unit 44 transmits the data signal supplied to a data line (one of D1 to Dm) to the first pixel 40 and the second pixel 42 when a scan signal is supplied to the scan line (one of S1 to Sn) coupled thereto.

The first pixel 40 is positioned on the ith horizontal line and is selected to receive a data signal from the common coupling unit 44 when a first control signal is supplied to the first control line CL1.

The second pixel 42 is positioned on the (i+1)th horizontal line and is selected to receive a data signal from the common coupling unit 44 when a second control signal is supplied to the second control line CL2.

The scan driver 10 sequentially supplies scan signals to the scan lines S1 to Sn. Here, the scan lines S1 to Sn are coupled to the common coupling units 44 so that one scan line is formed every two horizontal lines. That is, according to the described embodiment of the present invention, the number of scan lines S1 to Sn may be reduced to ½ in comparison with conventional art.

Since the common coupling unit 44 is coupled to the first pixel 40 and the second pixel 42 positioned on the two horizontal lines, the scan signals are supplied to the scan lines S1 to Sn for a period exceeding one horizontal period (1 H), for example, 2 H so that the data signals may be sequentially supplied to the first pixel 40 and the second pixel 42.

The data driver 20 supplies the data signals to the data lines D1 to Dm in synchronization with the scan signals. Here, the data driver 20 sequentially supplies a first data signal to be supplied to the first pixel 40, and a second data signal to be supplied to the second pixel 42, to the data lines D1 to Dm in a period where one scan signal is supplied.

The first control line CL1 is commonly coupled to the first pixels 40 formed in the display unit 30.

The second control line CL2 is commonly coupled to the second pixels 42 formed in the display unit 30.

The control line driver 60 sequentially supplies the first control signal to the first control line CL1 and the second control signal to the second control line CL2 in a period where the scan signals are supplied to the scan lines S1 to Sn. Here, the first control signal is supplied in synchronization with the first data signal and the second control signal is supplied in synchronization with the second data signal.

The timing controller 50 controls the scan driver 10, the data driver 20, and the control line driver 60.

Figure 2:
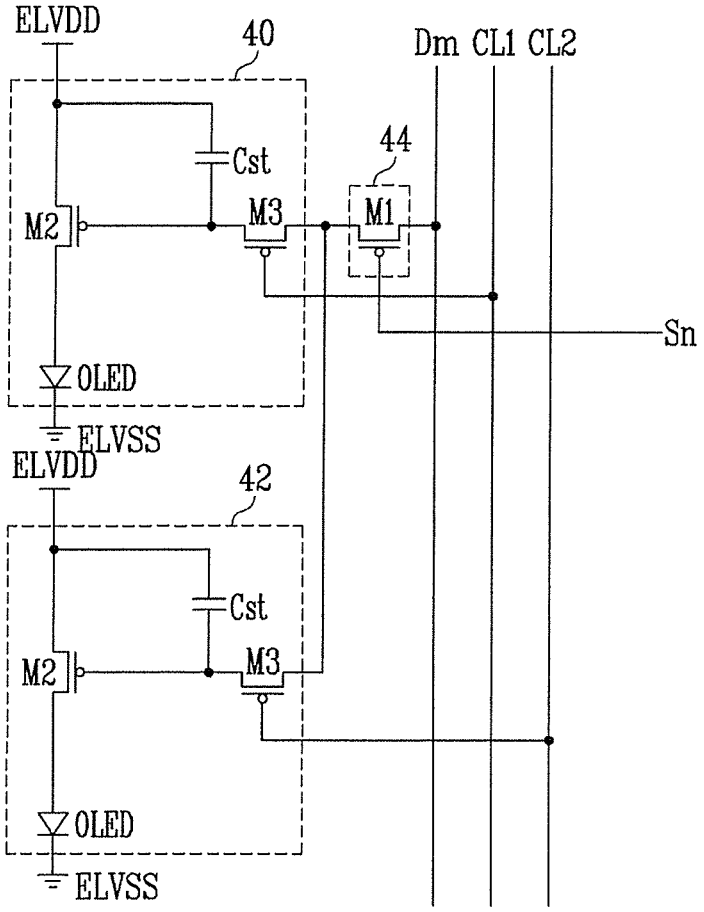
FIG. 2 is a circuit diagram illustrating a common coupling unit, a first pixel, and a second pixel of the organic light emitting display of FIG. 1.

FIG. 2 is a circuit diagram illustrating a common coupling unit, a first pixel, and a second pixel of the organic light emitting display of FIG. 1. In FIG. 2, for the sake of convenience, a common coupling unit coupled to an nth scan line Sn and an mth data line Dm will be illustrated.

Referring to FIG. 2, the common coupling unit 44 includes a first transistor M1 positioned between the data line Dm and the first pixel 40 and the second pixel 42. The first transistor M1 is turned on when a scan signal is supplied to the scan line Sn, to electrically couple the data line Dm to the first pixel 40 and the second pixel 42.

Each of the first pixel 40 and the second pixel 42 includes an organic light emitting diode (OLED), a second transistor M2, a third transistor M3, and a storage capacitor Cst.

The OLED is coupled between a second transistor M2 and a second power source ELVSS. The OLED generates light with a brightness level (e.g., a predetermined brightness) corresponding to the amount of current supplied from the second transistor M2.

The second transistor M2 is coupled between a first power source ELVDD and the OLED. The second transistor M2 controls the amount of current supplied to the OLED to correspond to the voltage (that is, the voltage charged in the storage capacitor) applied to the gate electrode thereof.

The storage capacitor Cst is coupled between the gate electrode of the second transistor M2 and the first power source ELVDD. The storage capacitor Cst is charged with a voltage corresponding to the data signal.

The third transistor M3 is coupled between the common coupling unit 44 and the gate electrode of the second transistor M2. The third transistor M3 is turned on when the first control signal is supplied to the first control line CL1 or when the second control signal is supplied to the second control line CL2.

That is, the third transistor M3 included in the first pixel 40 is turned on when the first control signal is supplied to the first control line CL1, and the third transistor M3 included in the second pixel 42 is turned on when the second control signal is supplied to the second control line CL2.

Figure 3:
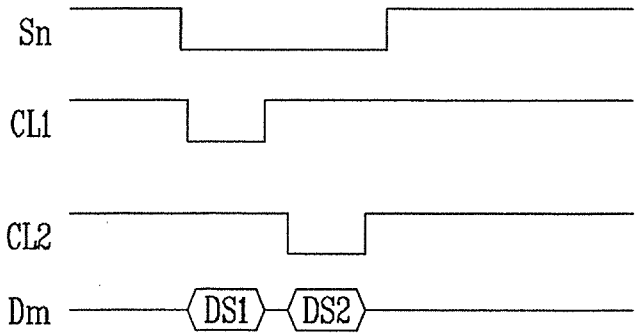
FIG. 3 is a waveform chart illustrating a method of driving the first and second pixels of FIG. 2.

FIG. 3 is a waveform chart illustrating a method of driving the first and second pixels of FIG. 2.

Referring to FIG. 3, first, a scan signal is supplied to the scan line Sn to turn on the first transistor M1. When the first transistor M1 is turned on, the first pixel 40 and the second pixel 42 are electrically coupled to the data line Dm.

At the same time, the first control signal is supplied to the first control line CL1 so that the third transistor M3 included in the first pixel 40 is turned on. When the third transistor M3 included in the first pixel 40 is turned on, a first data signal DS1 from the data line Dm is supplied to the gate electrode of the second transistor M2 included in the first pixel 40. In this case, the storage capacitor Cst included in the first pixel 40 is charged with a voltage corresponding to the first data signal DS1. After the voltage corresponding to the first data line DS1 is charged in the storage capacitor Cst included in the first pixel 40, the second control signal is supplied to the second control line CL2.

The second control signal is supplied to the second control line CL2 so that the third transistor M3 included in the second pixel 42 is turned on. When the third transistor M3 included in the second pixel 42 is turned on, a second data signal DS2 from the data line Dm is supplied to the gate electrode of the second transistor M2 included in the second pixel 42. In this case, the storage capacitor Cst included in the second pixel 42 is charged with a voltage corresponding to the second data signal DS2. Then, the second transistors M2 included in the first pixel 40 and the second pixel 42 control the amount of current that flows to the OLEDs to correspond to the voltages charged in the storage capacitors Cst.

According to the above-described present invention, since only one scan line (one of S1 to Sn) is formed to correspond to the first pixel 40 and the second pixel 42 positioned on different horizontal lines, the number of scan lines S1 to Sn may be reduced (or minimized). In addition, the scan signals are supplied to the scan lines S1 to Sn formed in a horizontal direction in a period of 2 H. In this case, although delay may be generated at the rising/falling times of the scan signals in a large display panel, a transistor (here, M1) may be stably turned on and off.

In addition, according to an embodiment of the present invention, the first pixel 40 and the second pixel 42 are selected using the first control line CL1 and the second control line CL2 formed in a vertical direction. In one embodiment, the first control line CL1 and the second control line CL2 formed in the vertical direction have a length shorter than the scan lines S1 to Sn. Therefore, the first control signal and the second control signal have relatively short rising/falling delays so that a transistor (here, M3) may be stably turned on and off.

While in FIG. 2 an embodiment of the present invention is realized using a well-known pixel structure of 2TR 1 Cap, the present invention is not limited to the above. That is, the present invention may be applied to various types of pixels known to those skilled in the art.

Figure 4:
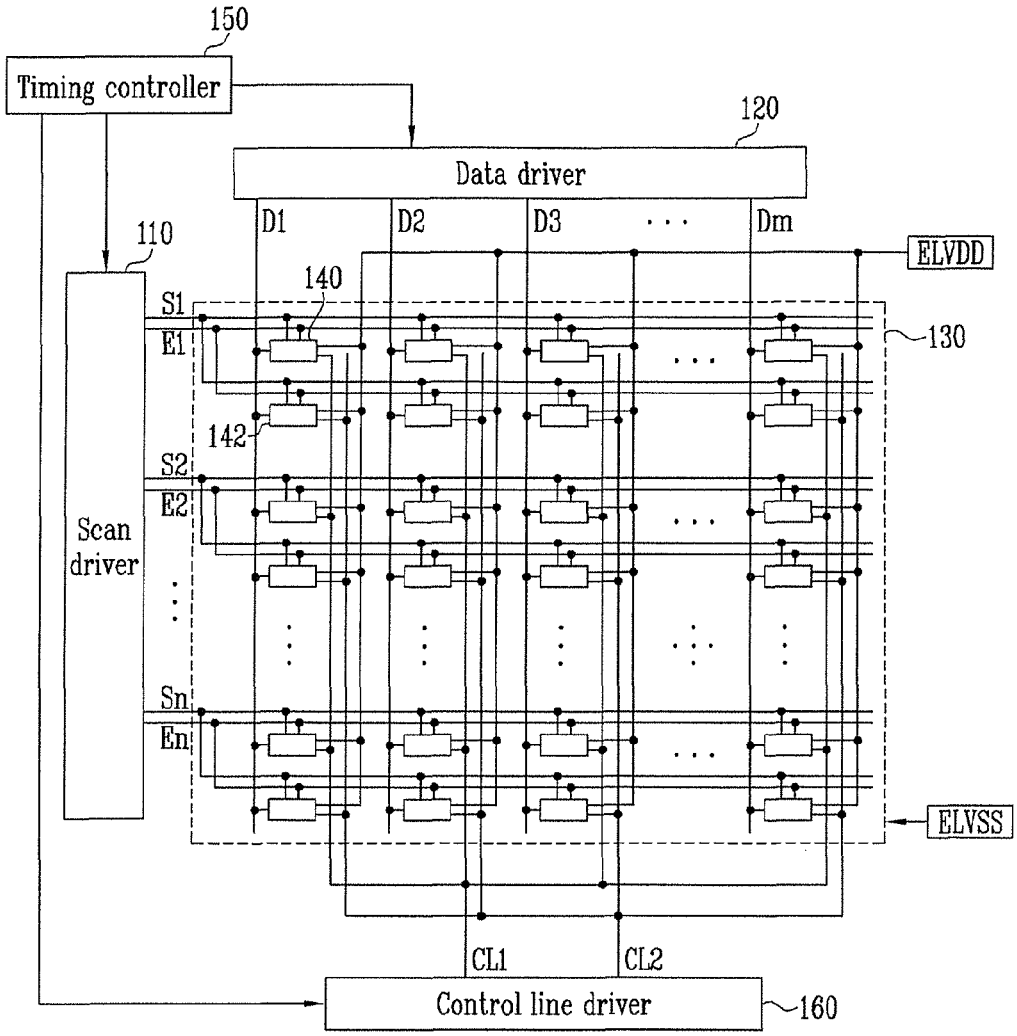
FIG. 4 is a view illustrating an organic light emitting display according to another embodiment of the present invention.

FIG. 4 is a view illustrating an organic light emitting display according to another embodiment of the present invention.

Referring to FIG. 4, an organic light emitting display according to another embodiment of the present invention includes a display unit 130 including first pixels 140 positioned on an ith horizontal line and second pixels 142 positioned on an (i+1)th horizontal line, a first control line CL1 coupled to the first pixels 140, a second control line CL2 coupled to the second pixels 142, scan lines S1 to Sn and emission control lines E1 to En coupled to the first pixels 140 and the second pixels 142, a scan driver 110 for driving the scan lines S1 to Sn and the emission control lines E1 to En, a data driver 120 for driving data lines D1 to Dm, a control line driver 160 for driving the first control line CL1 and the second control line CL2, and a timing controller 150 for controlling the scan driver 110, the data driver 120, and the control line driver 160.

The first pixel 140 is positioned on the ith horizontal line and is selected to be coupled to a data line (one of D1 to Dm) when the first control signal is supplied to the first control line CL1.

The second pixel 142 is positioned on the (i+1)th horizontal line and is selected to be coupled to a data line (one of D1 to Dm) when the second control signal is supplied to the second control line CL2.

The scan driver 110 sequentially supplies the scan signals to the scan lines S1 to Sn. Here, the scan lines S1 to Sn are coupled to the pixels 140 and 142 positioned on two horizontal lines. In this case, the scan signals are supplied in a period of 2 H so that the data signals may be sequentially supplied to the first pixel 140 and the second pixel 142 coupled to the scan lines S1 to Sn. In addition, the scan driver 110 supplies an emission control signal to a jth emission control line Ej to overlap the scan signals supplied to a (j−1)th (j is a natural number) scan line Sj−1 and a jth scan line Sj.

The data driver 120 supplies the data signals to the data lines D1 to Dm in synchronization with the scan signals. Here, the data driver 120 sequentially supplies a first data signal to be supplied to the first pixel 140 and a second data signal to be supplied to the second pixel 142 to the data lines D1 to Dm in a period where one scan signal is supplied.

The first control line CL1 is commonly coupled to the first pixels 140 formed in the display unit 130.

The second control line CL2 is commonly coupled to the second pixels 142 formed in the display unit 130.

The control line driver 160 sequentially supplies the first control signal to the first control line CL1 and the second control signal to the second control line CL2 in a period where the scan signals are supplied to the scan lines S1 to Sn. Here, the first control signal is supplied in synchronization with the first data signal and the second control signal is supplied in synchronization with the second data signal.

The timing controller 150 controls the scan driver 110, the data driver 120, and the control line driver 160.

Figure 5:
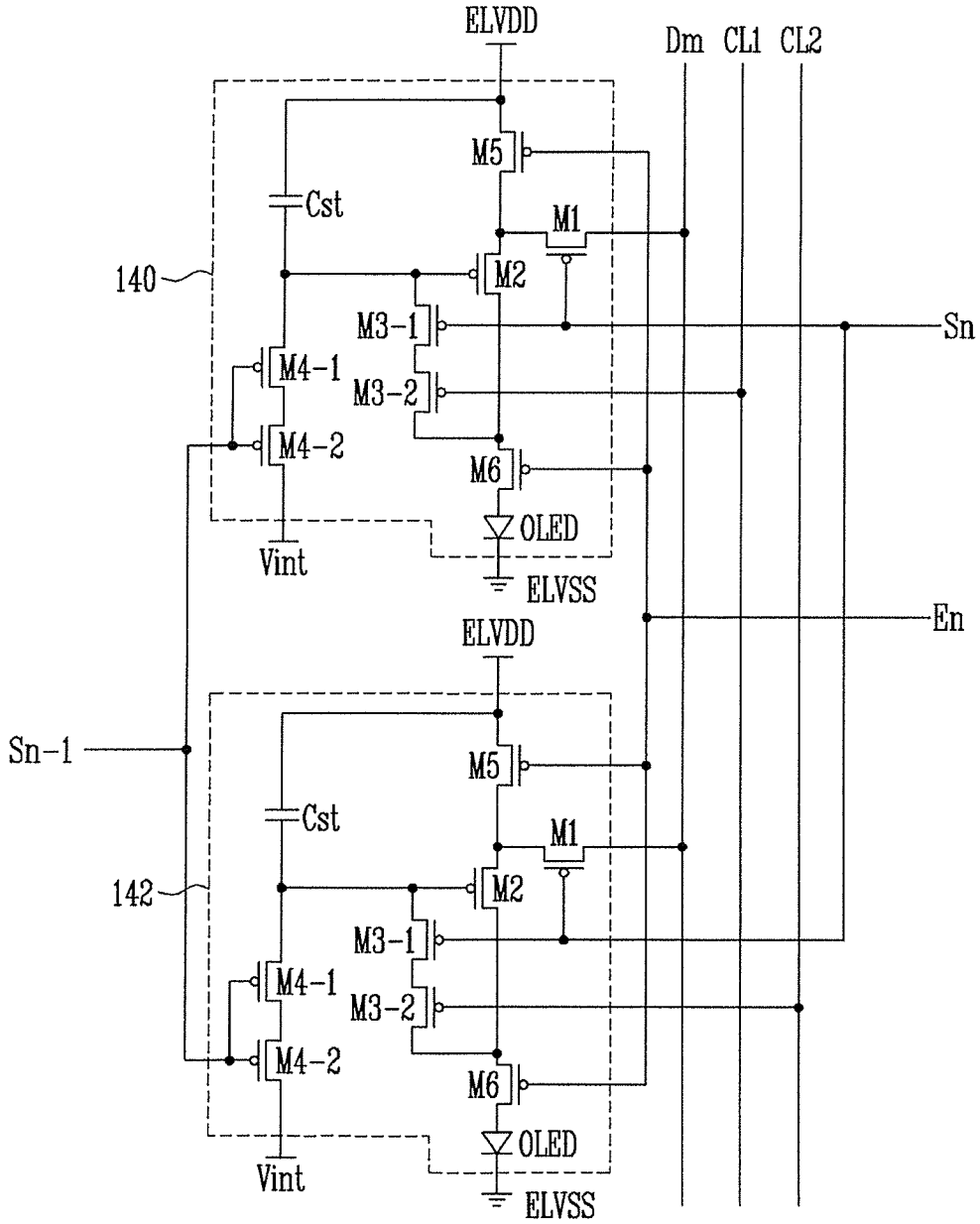
FIG. 5 is a circuit diagram illustrating an embodiment of a first pixel and a second pixel of the organic light emitting display of FIG. 4.

FIG. 5 is a circuit diagram illustrating an embodiment of a first pixel and a second pixel of the organic light emitting display of FIG. 4. In FIG. 5, for the sake of convenience, a first pixel and a second pixel coupled to an nth scan line Sn and an mth data line Dm will be described.

Referring to FIG. 5, each of the first pixel 140 and the second pixel 142 includes an organic light emitting diode (OLED), a storage capacitor Cst, and first to sixth transistors M1 to M6.

The OLED is coupled between the second transistor M2 and a second power source ELVSS. The OLED generates light with a brightness level (e.g., a predetermined brightness) corresponding to the amount of current supplied from the second transistor M2.

The second transistor M2 is coupled between a first power source ELVDD and the OLED. The second transistor M2 controls the amount of current supplied to the OLED to correspond to the voltage applied to the gate electrode thereof.

The first transistor M1 is coupled between the data line Dm and the first electrode of the second transistor M2. The first transistor M1 is turned on when a scan signal is supplied to the nth scan line Sn.

The third transistors M3-1 and M3-2 are constituted so that a plurality of (for example, two) transistors M3-1 and M3-2 are serially coupled between the gate electrode of the second transistor M2 and the second electrode of the second transistor M2, so that leakage current supplied from the storage capacitor Cst to the OLED is reduced (or minimized). In the third transistors M3-1 and M3-2, the first third transistor M3-1 is turned on when a scan signal is supplied to the nth scan line Sn. In the third transistors M3-1 and M3-2, the second third transistor M3-2 is turned on when the first control signal is supplied to the first control line CL1 or when the second control signal is supplied to the second control line CL2.

That is, the second third transistor M3-2 included in the first pixel 140 is turned on when the first control signal is supplied to the first control line CL1, and the second third transistor M3-2 included in the second pixel 142 is turned on when the second control signal is supplied to the second control line CL2.

The fourth transistors M4-1 and M4-2 are constituted so that a plurality of (for example, two) transistors M4-1 and M4-2 are serially coupled between the gate electrode of the second transistor M2 and an initial power source Vint so that the leakage current supplied from the storage capacitor Cst to the initial power source Vint is reduced (or minimized). The fourth transistors M4-1 and M4-2 are turned on when a scan signal is supplied to an (n−1)th scan line Sn−1. The initial power source Vint is set to have a lower voltage value than a data signal.

The first electrode of the fifth transistor M5 is coupled to the first power source ELVDD and the second electrode of the fifth transistor M5 is coupled to the first electrode of the second transistor M2. The gate electrode of the fifth transistor M5 is coupled to an emission control line En. The fifth transistor M5 is turned off when an emission control signal is supplied to the emission control line En and is turned on when the emission control signal is not supplied.

The first electrode of the sixth transistor M6 is coupled to the second electrode of the second transistor M2 and the second electrode of the sixth transistor M6 is coupled to the anode electrode of the OLED. The gate electrode of the sixth transistor M6 is coupled to the emission control line En. The sixth transistor M6 is turned off when the emission control signal is supplied to the emission control line En and is turned on when the emission control signal is not supplied.

The storage capacitor Cst is coupled between the gate electrode of the second transistor M2 and the first power source ELVDD. The storage capacitor Cst is charged with a voltage corresponding to the data signal.

Figure 6:
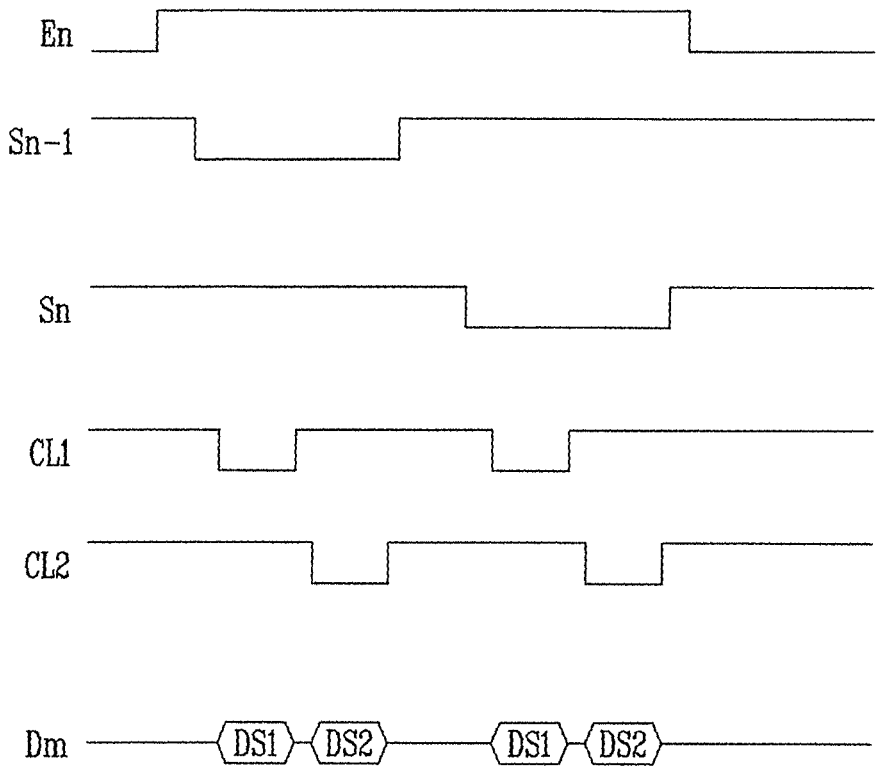
FIG. 6 is a waveform chart illustrating a method of driving the first and second pixels of FIG. 5.

FIG. 6 is a waveform chart illustrating a method of driving the first and second pixels of FIG. 5.

Referring to FIG. 6, first, the emission control signal is supplied to the emission control line En so that the fifth transistor M5 and the sixth transistor M6 included in the first pixel 140 and the second pixel 142 are turned off. When the fifth transistor M5 and the sixth transistor M6 are turned off, electric couplings between the second transistor M2 and the first power source ELVDD and between the second transistor M2 and the OLED are blocked.

Then, the scan signal is supplied to the (n−1)th scan line Sn-1 so that the fourth transistors M4-1 and M4-2 included in the first pixel 140 and the second pixel 142 are turned on. When the fourth transistors M4-1 and M4-2 are turned on, the voltage of the initial power source Vint is supplied to the gate electrode of the second transistor M2. At this time, the gate electrode of the second transistor M2 is initialized to the voltage of the initial power source Vint.

On the other hand, in a period where the scan signal is supplied to the (n−1)th scan line Sn−1, the second third transistor M3-2 included in each of the first pixels 140 and the second pixels 142 is turned on to correspond to the first control signal supplied to the first control line CL1 and the second control signal supplied to the second control line CL2. However, since the first third transistor M3-1 remains in (or maintains) a turn off state, the gate electrode of the second transistor M2 stably maintains the voltage of the initial power source Vint.

Then, the scan signal is supplied to the nth scan line Sn so that the first transistor M1 and the first third transistor M3-1 included in each of the first pixels 140 and the second pixels 142 are turned on. When the first transistor M1 is turned on, the data line Dm and the first electrode of the second transistor M2 are electrically coupled to each other. Then, the first data signal DS1 and the second data signal DS2 are sequentially supplied to the first electrode of the second transistor M2 included in each of the first pixel 140 and the second pixel 142.

First, when the third transistor M3-1 is turned on, the gate electrode of the second transistor M2 and the second third transistor M3-2 are electrically coupled to each other.

Then, in a period where the scan signal is supplied to the nth scan line Sn, the first control signal and the second control signal are sequentially supplied to the first control line CL1 and the second control line CL2. When the first control signal is supplied to the first control line CL1, the second third transistor M3-2 included in the first pixel 140 is turned on. At this time, the gate electrode and the second electrode of the second transistor M2 included in the first pixel 140 are electrically coupled to each other so that the second transistor M2 is coupled in the form of a diode.

When the second transistor M2 included in the first pixel 140 is coupled in the form of a diode, the voltage obtained by subtracting the threshold voltage of the second transistor M2 from the first data signal DS1 supplied to the first electrode of the second transistor M2 is supplied to the gate electrode of the second transistor M2. At this time, the storage capacitor Cst included in the first pixel 140 is charged with voltages corresponding to the first data signal DS1 and the threshold voltage of the second transistor M2.

When the second control signal is supplied to the second control line CL2, the second third transistor M3-2 included in the second pixel 142 is turned on. At this time, the gate electrode and the second electrode of the second transistor M2 included in the second pixel 142 are electrically coupled to each other so that the second transistor M2 is coupled in the form of a diode.

When the second transistor M2 included in the second pixel 142 is coupled in the form of a diode, the voltage obtained by subtracting the threshold voltage of the second transistor M2 from the second data signal DS2 supplied to the first electrode of the second transistor M2 is supplied to the gate electrode of the second transistor M2. At this time, the storage capacitor Cst included in the second pixel 142 is charged with voltages corresponding to the second data signal DS2 and the threshold voltage of the second transistor M2.

Then, the supply of the emission control signal to the emission control line En is stopped so that the fifth transistor M5 and the sixth transistor M6 included in each of the first pixel 140 and the second pixel 142 are turned on. When the fifth transistor M5 and the sixth transistor M6 are turned on, a current path is formed to the OLED. At this time, the second transistor M2 included in each of the first pixel 140 and the second pixel 142 controls the amount of current that flows to the OLED to correspond to the voltage applied to the gate electrode thereof.

As described above, according to an embodiment of the present invention, since a single scan line and a single emission control line are formed to correspond to the first pixel 140 and the second pixel 142 positioned on different horizontal lines, the number of wiring lines may be reduced (or minimized). In addition, the signal lines (the scan lines and the emission control lines) formed in a horizontal direction are supplied in a period of no less than 2 H, and although delay may be generated at the rising/falling times of the signals, stable driving may be performed.

Furthermore, according to an embodiment of the present invention, the first pixel 140 and the second pixel 142 are selected using the first control line CL1 and the second control line CL2 formed in a vertical direction. Here, since the first control line CL1 and the second control line CL2 formed in the vertical direction are formed to be shorter than the scan lines S1 to Sn, the rising/falling times are reduced (or minimized) so that stable driving may be performed.

Figure 7:
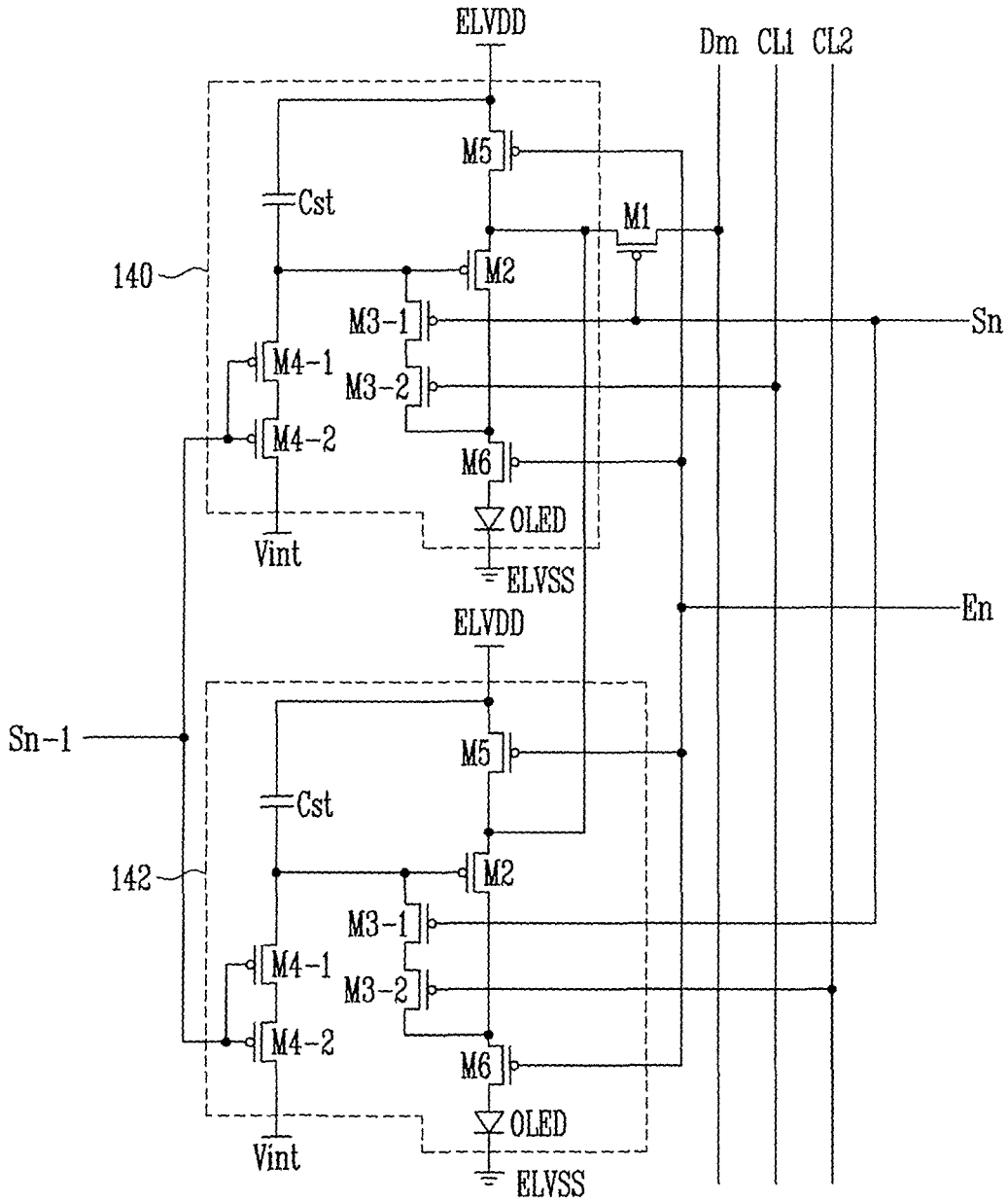
FIG. 7 is a circuit diagram illustrating another embodiment of a first pixel and a second pixel of the organic light emitting display of FIG. 4.

However, according to embodiments of the present invention, the structure of the pixel may vary in type. For example, the first transistor M1 may be commonly used by the pixels 140 and 142 illustrated in FIG. 5. That is, as illustrated in FIG. 7, the first transistor M1 may be formed outside the first pixel 140 and the second pixel 142. In this case, the first electrode of the first transistor M1 is coupled to the data line Dm and the second electrode of the first transistor M1 is coupled to the first electrode of the second transistor M2 included in each of the first pixel 140 and the second pixel 142.

When the first transistor M1 is formed as described above, the first pixel 140 and the second pixel 142 commonly use the first transistor M1. That is, the first pixel 140 and the second pixel 142 receive the first data signal DS1 and the second data signal DS2 via the commonly coupled first transistor M1. Here, since the structures and operation processes are the same as in FIG. 5 as described above except for (or excluding) the first transistor M1, detailed description will be omitted.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

first pixels on an ith horizontal line, wherein i is a positive integer;

second pixels on an (i+1)th horizontal line;

scan lines and emission control lines;

data lines crossing the scan lines and the emission control lines and coupled to the first pixels and the second pixels;

first control lines coupled to the first pixels; and second control lines coupled to the second pixels, wherein the scan lines comprise a first scan line coupled to the first pixels on the ith horizontal line and the second pixels positioned on the (i+1)th horizontal line, the first scan line for scanning the first pixels and the second pixels, wherein the emission control lines comprise a first emission control line coupled to the first pixels on the ith horizontal line and the second pixels on the (i+1)th horizontal line, and data signals are supplied to the first pixels and the second pixels when a scan signal is supplied to the first scan line.

2. The organic light emitting display as claimed in claim 1, further comprising:

a scan driver for sequentially supplying scan signals to the scan lines and for sequentially supplying emission control signals to the emission control lines;

a data driver for supplying the data signals to the data lines; and a control line driver for supplying a first control signal to the first control lines and for supplying a second control signal to the second control lines.

3. The organic light emitting display as claimed in claim 2, wherein the scan driver is configured to supply each of the scan signals to have a duration of two horizontal periods.

4. The organic light emitting display as claimed in claim 3, wherein the scan driver is configured to supply one of the emission control signals to a jth emission control line from among the emission control lines to overlap the scan signals supplied to a (j−1)th scan line and a jth scan line from among the scan lines, wherein j is a positive integer, wherein the first scan line is the jth scan line, and the first emission control line is the jth emission control line.

5. The organic light emitting display as claimed in claim 2, wherein the control line driver is configured to sequentially supply the first control signal and the second control signal while the scan signals are being supplied.

6. The organic light emitting display as claimed in claim 5, wherein the data driver is configured to supply a first data signal of the data signals, to be supplied to a corresponding one of the first pixels, to a corresponding one of the data lines while the first control signal is being supplied, and to supply a second data signal of the data signals, to be supplied to a corresponding one of the second pixels, to a corresponding one of the data lines while the second control signal is being supplied.

7. The organic light emitting display as claimed in claim 2, wherein each of the first pixels and the second pixels comprises:

an OLED;

a second transistor for controlling an amount of current supplied from a first power source coupled to a first electrode of the second transistor to the OLED;

a first transistor coupled between the first electrode of the second transistor and a corresponding one of the data lines and configured to turn on when one of the scan signals is supplied to a jth scan line from among the scan lines, wherein j is a positive integer;

a storage capacitor coupled between a gate electrode of the second transistor and the first power source;

a fourth transistor serially coupled between the gate electrode of the second transistor and an initial power source and configured to turn on when one of the scan signals is supplied to a (j−1)th scan line from among the scan lines;

a fifth transistor coupled between the second transistor and the first power source and configured to turn off when one of the emission control signals is supplied to a jth emission control line from among the emission control lines; and a sixth transistor coupled between the second transistor and the OLED and configured to turn off when the one of the emission control signals is supplied to the jth emission control line, wherein the first scan line is the jth scan line, and the first emission control line is the jth emission control line.

8. The organic light emitting display as claimed in claim 7, wherein each of the first pixels further comprises:

a first third transistor coupled between the gate electrode of the second transistor and a second electrode of the second transistor and configured to turn on when the one of the scan signals is supplied to the jth scan line; and a second third transistor coupled between the first third transistor and the second electrode of the second transistor and configured to turn on when the first control signal is supplied to a corresponding one of the first control lines.

9. The organic light emitting display as claimed in claim 7, wherein each of the second pixels further comprises:

a first third transistor coupled between the gate electrode of the second transistor and a second electrode of the second transistor and configured to turn on when the one of the scan signals is supplied to the jth scan line; and a second third transistor coupled between the first third transistor and the second electrode of the second transistor and configured to turn on when the second control signal is supplied to a corresponding one of the second control lines.

* * * * *